US011328844B2

(12) United States Patent
Choon et al.

(10) Patent No.: US 11,328,844 B2
(45) Date of Patent: May 10, 2022

(54) SELF-LOCKING LUG PROTECTOR

(71) Applicant: SAFRAN ELECTRICAL & POWER, Blagnac (FR)

(72) Inventors: Hean Yew Choon, Snohomish, WA (US); Abner Jaen Quezada Delgado, Everett, WA (US)

(73) Assignee: SAFRAN ELECTRICAL & POWER, Blagnac (FR)

( * ) Notice: Subject to any disclaimer, the term of this patent is extended or adjusted under 35 U.S.C. 154(b) by 178 days.

(21) Appl. No.: 16/807,889

(22) Filed: Mar. 3, 2020

(65) Prior Publication Data

US 2020/0294696 A1 Sep. 17, 2020

Related U.S. Application Data

(60) Provisional application No. 62/816,546, filed on Mar. 11, 2019.

(51) Int. Cl.

| | |
|---|---|
| ***H01B 17/58*** | (2006.01) |
| ***H01R 11/12*** | (2006.01) |
| ***H01R 13/44*** | (2006.01) |
| ***H01R 13/426*** | (2006.01) |

(52) U.S. Cl.

CPC ..... *H01B 17/58* (2013.01); *H01R 11/12* (2013.01)

(58) Field of Classification Search

CPC ..... H02G 15/02; H02G 15/04; H02G 3/02; H02G 1/14; H01R 13/426; H01R 13/44; H01R 2201/26; H01R 11/12; H01R 11/11

See application file for complete search history.

(56) References Cited

U.S. PATENT DOCUMENTS

| | | | | |
|---|---|---|---|---|
| 2003/0224638 | A1* | 12/2003 | Nishimoto | H01R 11/12 439/135 |
| 2009/0318002 | A1* | 12/2009 | Murano | H01R 11/12 439/278 |
| 2020/0274260 | A1* | 8/2020 | Hisada | H01R 11/09 |

* cited by examiner

*Primary Examiner* — Hoa C Nguyen
*Assistant Examiner* — Amol H Patel
(74) *Attorney, Agent, or Firm* — Rankin, Hill & Clark LLP

(57) ABSTRACT

A wiring protection device includes a main body that defines a cavity for receipt of an associated lug of an associated wiring harness. The wiring protection device also includes a first locking member that is slidably received in the main body to define a lock, position that engages the associated lug to prevent removal of the associated lug from the main body and an unlock position that does not engage the associated lug and allows removal and installation of the associated lug out of and into the main body.

20 Claims, 6 Drawing Sheets

SELF-LOCKING LUG PROTECTOR

BACKGROUND

Wiring harnesses are installed in a variety of vehicles including, for example, aircraft. The wiring harnesses can be used to communicate electricity for power or signaling purposes. These wiring harnesses typically include at least one lug for attachment to other components, including for example, terminal blocks.

During preparation for installation of the wiring harnesses into the vehicles, the lugs of the wiring harnesses may be protected from damage by wrapping the lug with bubble wrap and utilizing a rubber band to attach the bubble wrap to the lug. However, this type of protection must to be removed prior to final installation in the vehicle. However, this leave the lug unprotected throughout the installation process in the vehicle and therefore leads to potential damage of the component.

Nor is this type of protection mechanically secured to the lug, thereby risking the possibility of foreign object debris (FOD). This is especially undesirable with aircraft. Additionally, this type of protection is bulky and interferences with installation on the aircraft.

Nor does this type of protection allow for visual identification of the lug to determine orientation for proper installation. Further, this type of protection takes significant time to apply and remove from the lug of the wiring harness. Finally, a user is required to utilize both hands to apply and remove the protection. Accordingly, a more advanced lug protector is needed.

SUMMARY

In view of the foregoing, a wiring protection device includes a main body that defines a cavity for receipt of an associated lug of an associated wiring harness. The wiring protection device also includes a first locking member that is slidably received in the main body to define a lock position that engages the associated lug to prevent removal of the associated lug from the main body and an unlock position that does not engage the associated lug and allows removal and installation of the associated lug out of and into the main body.

DETAILED DESCRIPTION

Figure 1:
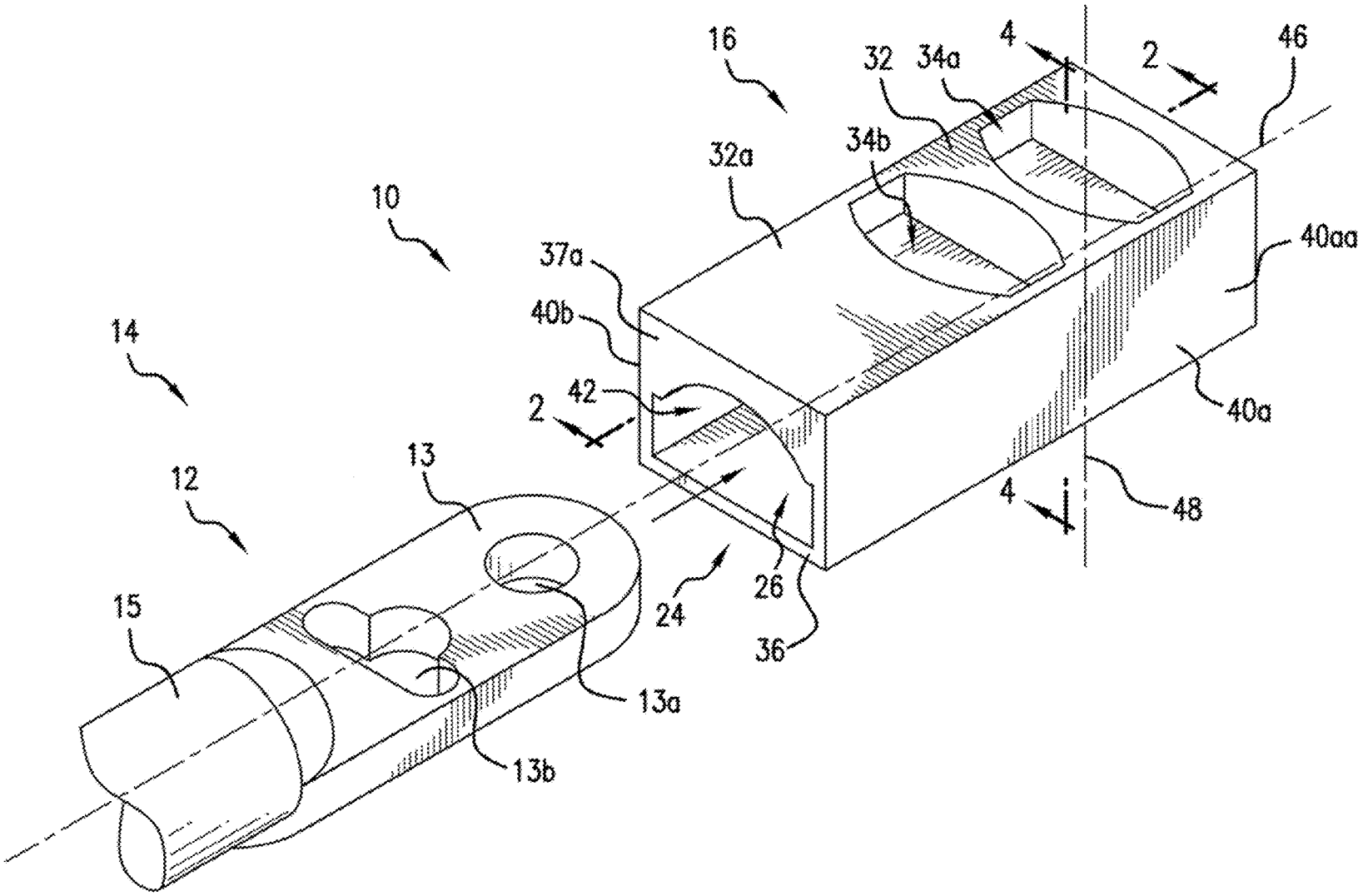
FIG. 1 perspective view of a wiring protection device and wiring harness.

With reference to FIG. 1, a wiring protection device 10 for protecting a wiring harness 14 with a lug 12 is shown. The lug 12 can include a tab 13 and a wire joining portion 15. The tab 13 can be utilized for electrically and mechanically connecting the wiring harness 14 to the terminal block (not shown).

The wire joining portion 15 of the tab 13 serves at the location at which a wire (not shown) of the wiring harness 14 is physically and mechanically attached to the lug 12 of the wiring harness 14. The tab 13 of the lug 12 can have a first aperture 13*a* and a second aperture 13*b* to aid in attachment to the terminal block (not shown). However, it will be appreciated that the tab 13 could include more than or less than two apertures without departing from the scope of this disclosure.

Figure 2:
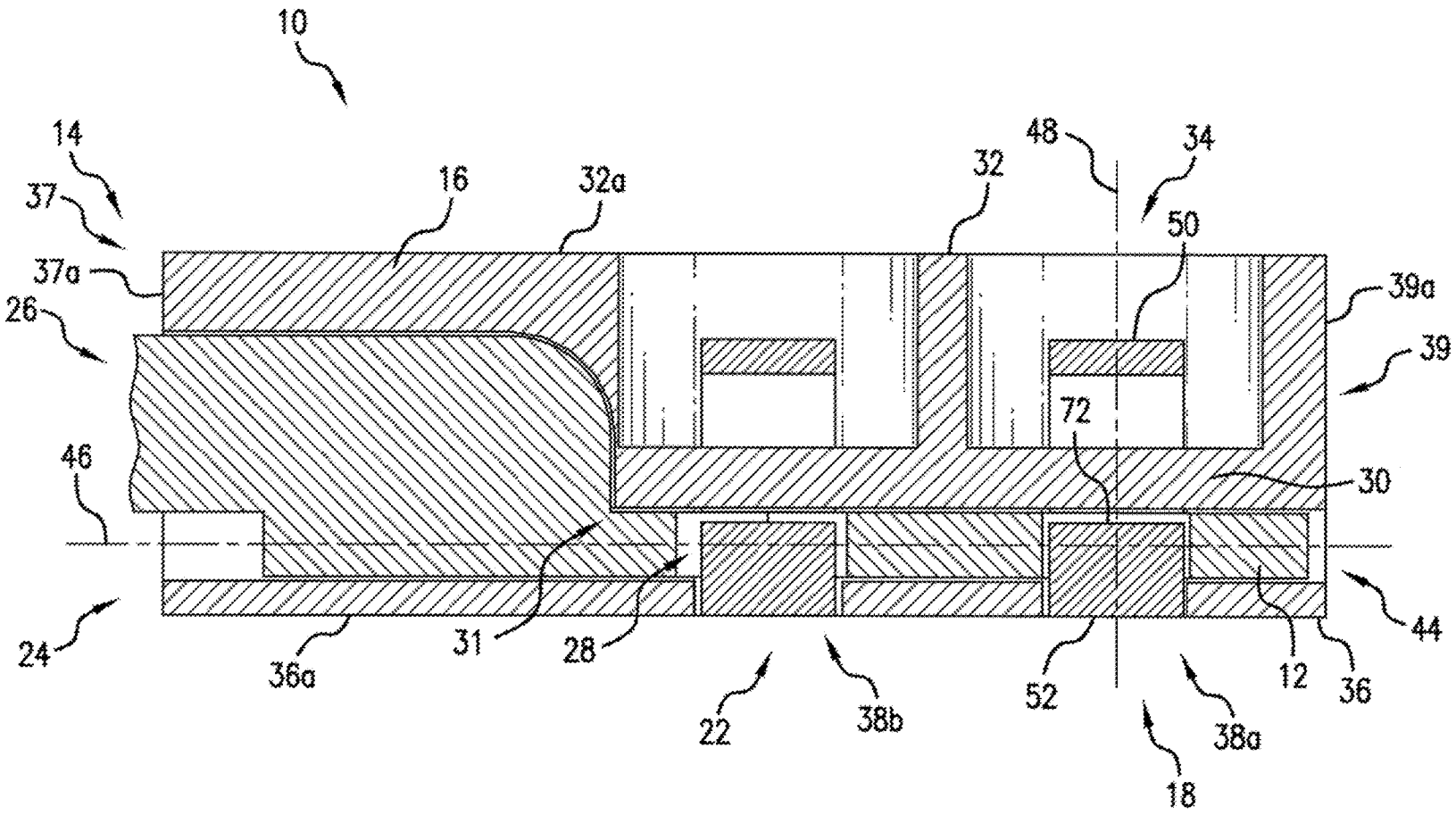
FIG. 2 is a sectional elevation view along line 2-2 of FIG. 1 of the wiring protection device in a lock position.
Figure 3:
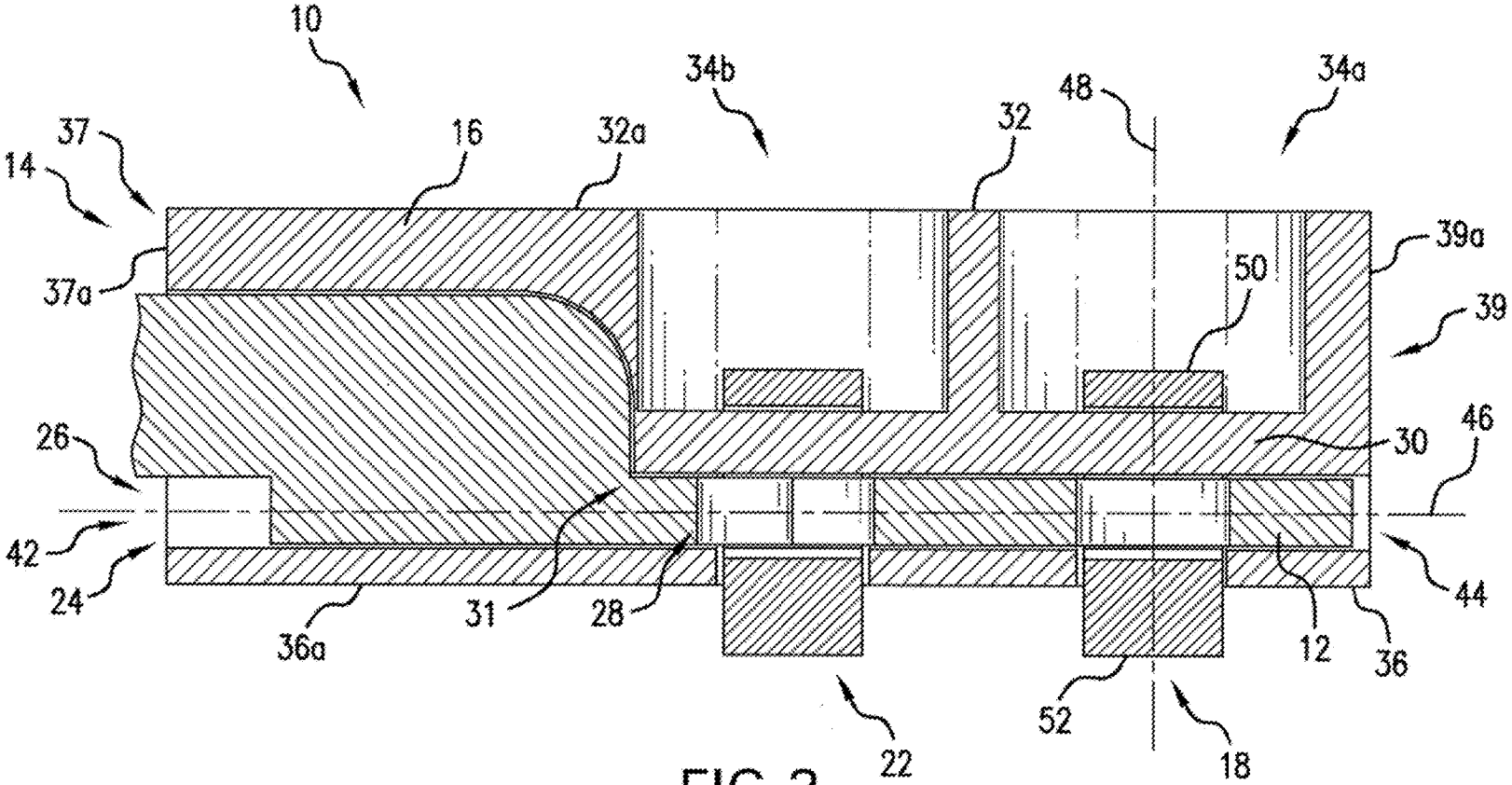
FIG. 3 is a sectional elevation view of the wiring protection device in an unlock position.

As shown in FIGS. 2-3, the wiring protection device 10 can include a main body 16, a first locking member 18, and a second locking member 22. The first locking member 18 and the second locking member 22 are independently and slidably received in the main body 16 to selectively engage the lug 12. As will be described in more detail hereinafter, the first locking member 18 is slidably received in the main body 16 so as to define an engagement axis 46. This slidable engagement along the engagement axis 46 allows for single-hand manipulation of the wiring protection device, thereby reducing labor costs during installation of the wiring harness 14 into the vehicle. Further, insertion of the lug 12 into the wiring protection device 10 defines a lug insertion axis 48. The engagement axis 46 is orthogonal to the lug insertion axis 48.

The main body 16, the first locking member 18, and the second locking member 22, can be made of the same material or dissimilar materials as one another. These materials could include, for example, a variety of polymers, such as thermoplastic polycarbonate. However, other material types are also envisioned as would be understood by one of ordinary skill in the art. Further still, these components could be made by a variety of techniques, including, for example, 3D printing. Finally, the main body 16, the first locking member 18, and the second locking member 22 can be made of an electrically insulative material.

The main body 16 defines a cavity 24 for receipt of the lug 12 of the wiring harness 14. Additionally, the main body 16 includes a proximal region 26 and a distal region 28 that are disposed at opposite longitudinal ends of the wiring protection device 10. As illustrated, the first locking member 18 is slidably received in the distal region 28.

Additionally, the second locking member 22 can be slidably received in the distal region 28. Upon insertion of the lug 12 into the wiring protection device 10, the proximal region 26 is configured to initially receive the tab 13 of the lug and then only the wire joining portion 15 of the lug 12, whereas the distal region 28 can be configured to only receive the tab 13 of the lug 12.

As shown in FIGS. 2-6, the main body 16 can also include an upper wall 32 with an upper surface 32*a*, a lower wall 36 with a lower surface 36*a*, a proximal wall 37 with a proximal surface 37*a*, a distal wall 39 with a distal surface 39*a*, and a pair of main body side walls 40*a*, 40*b* with a respective pair of side surfaces 40*aa*, 40*ba*. The upper wall 32 and the lower wall 36 can be spaced from one another and can be generally parallel to one another with the upper surface 32*a* and the lower surface 36*a* facing in opposite directions to one another.

The proximal wall 37 and the distal wall 39 can be spaced from one another and can be generally parallel to one another with the proximal surface 37*a* and the distal surface 39*a* facing in opposite directions to one another. Also, the proximal surface 37*a* of the proximal wall 37 can be adjacent the proximal region 26 and the distal surface 39*a* of the distal wall 39 can be adjacent the distal region 28. Further, the pair of main body side walls 40*a*, 40*b* can be spaced from one another and can be generally parallel to one another with the respective side surfaces 40*aa*, 40*ba* facing in opposite directions to one another.

The pair of main body side wall 40*a*, 40*b* cooperate to connect the upper wall 32 and the lower wall 36 together. Additionally, the proximal wall 37 and the distal wall 39 can cooperate with to connect the upper wall 32 and the lower wall 36 together. This arrangement provides for a compact size of the wiring protection device 10 so that it can be easily held in a single hand during installation.

Thus, the wiring protection device 10, and more particularly the main body 16, can be in the shape of a rectangular cuboid, commonly known as box shaped. However, it will be appreciated that other shapes are possible for the main body 16 and the wiring protection device 10 without departing from the scope of this disclosure.

With particular attention to FIGS. 1-3, the upper wall 32 can define a first unlocking port 34*a* and a second unlocking port 34*b*. Additionally, the lower wall 36 can define a first locking port 38*a* and a second locking port 38*b*. The first and second unlocking ports 34*a*, 34*b* allow easy access to the first locking member 18 and the second locking member 22, respectively, as will be described in more detail hereinafter It is also noted that either the first locking port 38*a* or the second locking port 38*b* provide an easy visual indicator of the orientation of the lug 12 of the wiring harness 14. Further, because a user can view a portion of the lug 12 of the wiring harness 14 through either the first locking port 38*a* or the second locking port 38*b*, the user can easily ascertain the type of lug 12 that is present, thereby simplifying installation of the wiring harness 14 into the aircraft.

As shown in FIGS. 2-3, the proximal wall 37 can define a proximal port 42 and the distal wall 39 can define a distal port 44 that are disposed at opposite ends of the main body 16. The proximal port 42 and the distal port 44 can be in fluid communication with one another. The proximal port 42 can slidably receive initially the tab 13 and then only the wire joining portion 15 of the lug 12, whereas the distal port 44 may only slidably receive the tab 13 of the lug 12 of the wiring harness 14.

Further, the first locking member 18 can be disposed between the distal port 44 and the second locking member 22 and the second locking member 22 can be disposed between the first locking member 18 and the proximal port 42. This arrangement allows for the wiring protection device 10 to be compact in size, thereby easing movement of the wiring protection device 10 throughout the vehicle during installation.

With continued attention to FIGS. 2-3, the cavity 24 can horizontally extend between the proximal region 26 and the distal region 28. The proximal region 26 defines a proximal region 26 volume and the distal region 28 defines a distal region 28 volume. The proximal region 26 is configured to receive the wire joining portion 15 of the lug 12 and the distal region 28 is configured to receive the tab 13 of the lug 12.

The proximal region 26 volume is greater than the distal region 28 volume so as to properly accommodate the lug 12 of the wiring harness 14, thereby ensuring sufficient protection of the wiring harness 14. As illustrated, the proximal region 26 can serve as a first point of entry for the lug 12 of the wiring harness 14 when the lug 12 is initially received by the wiring protection device 10, and more particularly, when the lug 12 is received by the main body 16.

Figure 4:
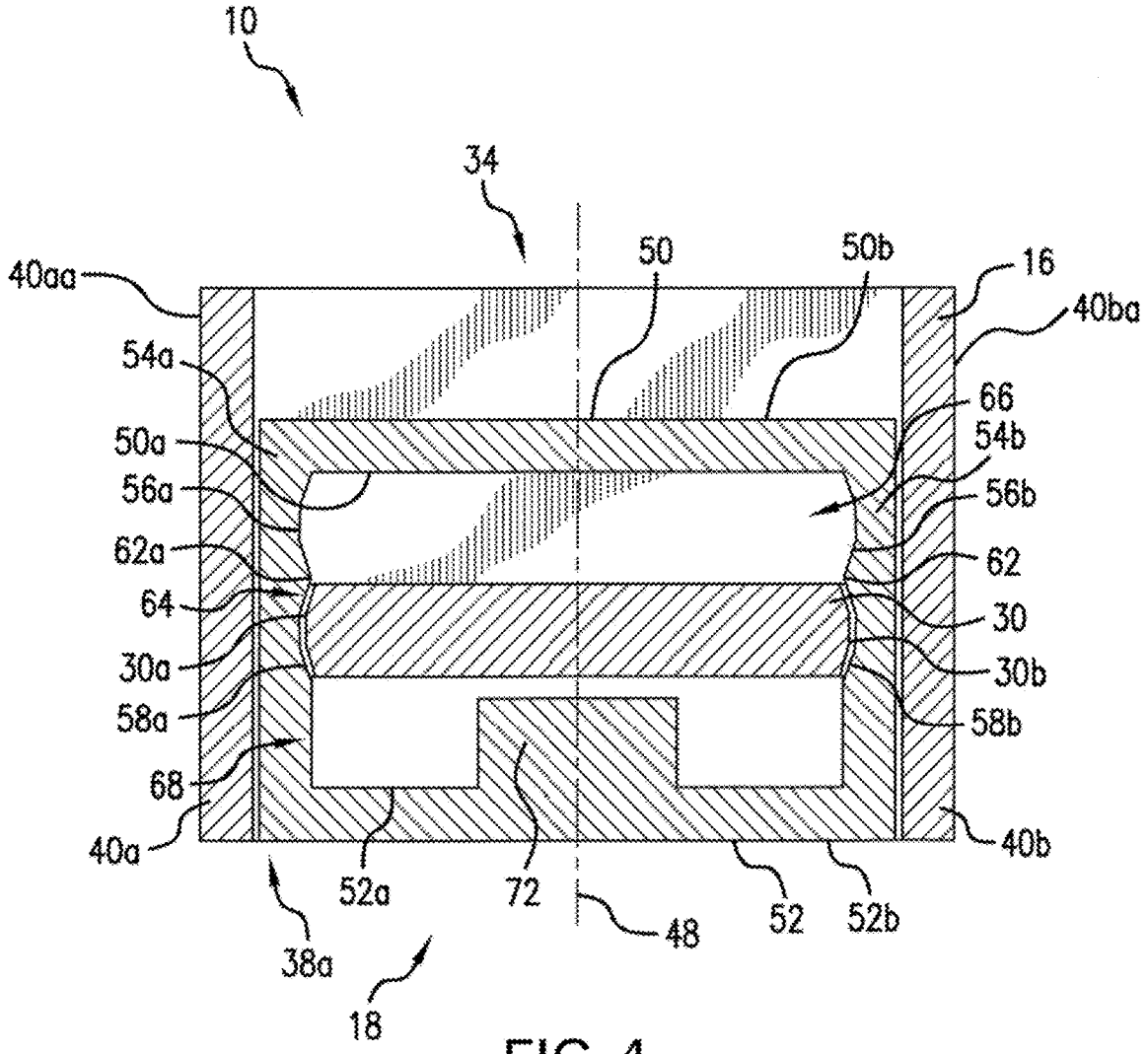
FIG. 4 is a sectional elevation view along line 4-4 of FIG. 1 of the wiring protection device in the lock position without the wiring harness.

The main body 16 can include a ledge portion 30 that extends through the first locking member 18 and the second locking member 22 for engagement with the first locking member 18 and the second locking member 22 as will be described in more detail hereinafter. With reference to FIG. 4, the ledge portion 30 includes a pair of curved faces 30*a*, 30*b*.

Figure 5:
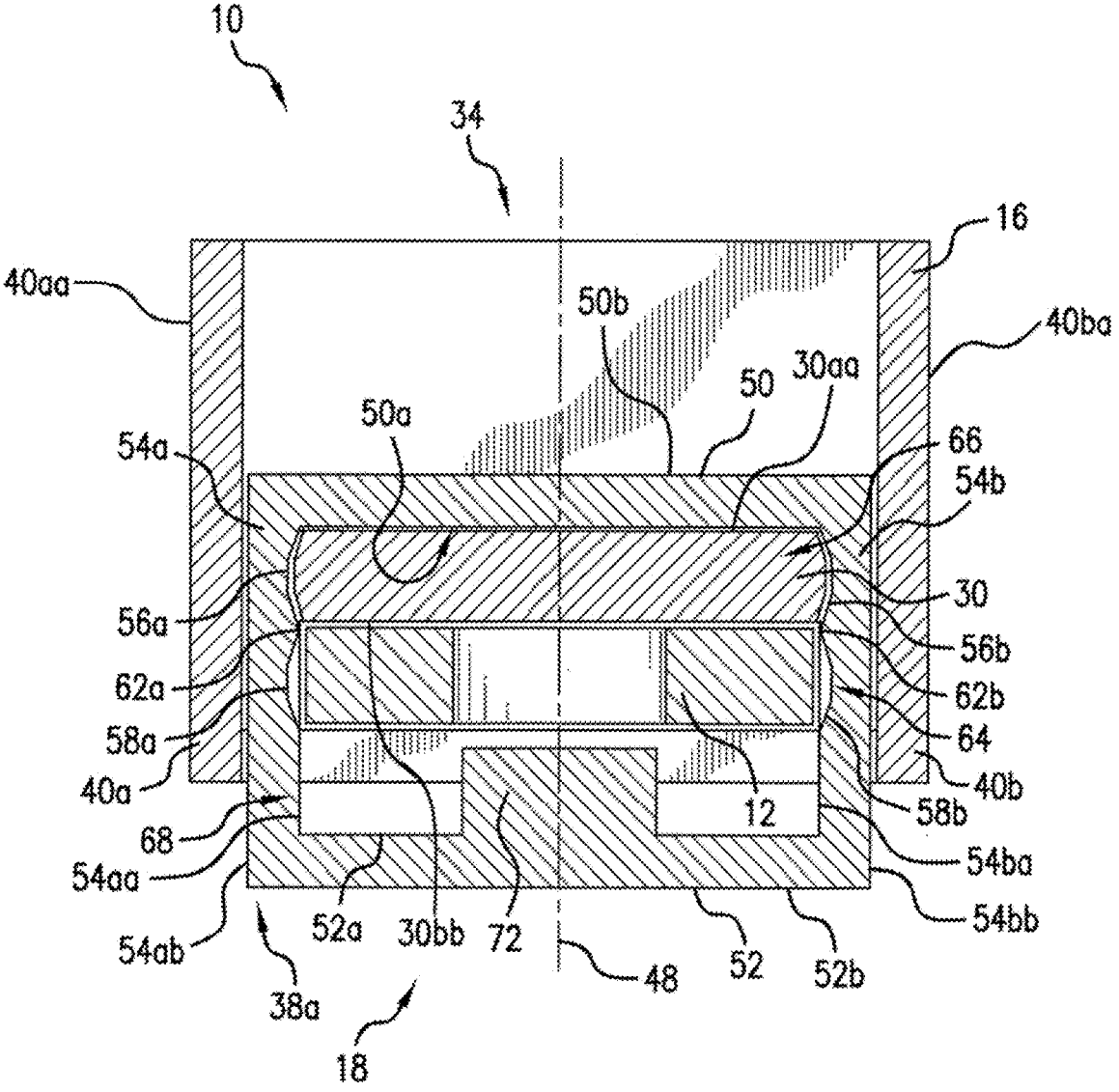
FIG. 5 is a sectional elevation view along line 4-4 of FIG. 1 of the wiring protection device in the unlock position with the wiring harness.

As shown in FIG. 5, the ledge portion can also include an upper face 30*aa* and a lower face 30*bb* that face in away from one another and in opposite directions. The upper face 30*aa* and the lower face 30*bb* cooperate with the pair of curved faces 30*a*, 30*b* to define a perimeter of the ledge portion 30 in cross-section.

The ledge portion 30 can extend from a junction 31 of the proximal region 26 and the distal region 28 to the distal wall 39. The ledge portion 30 is vertically disposed between the upper wall 32 and the lower wall 36 of the main body 16 and can be an integral part of the main body 16. Further, the ledge portion 30 can have a generally rectangular shape in cross-section and is fixed with respect to other components of the main body 16.

The ledge portion 30 can be disposed between and laterally spaced from the pair of main body side walls 40*a*, 40*b* such that a lateral distance between an outer edge of the ledge portion 30 and the engagement axis 46 is less than a lateral distance between the engagement axis 46 and the pair of side surfaces 40*aa*, 40*ba*. Further, the ledge portion 30 may define a height dimension along the engagement axis 46 so as to be received in the first locking member 18 and the second locking member 22.

Figure 6:
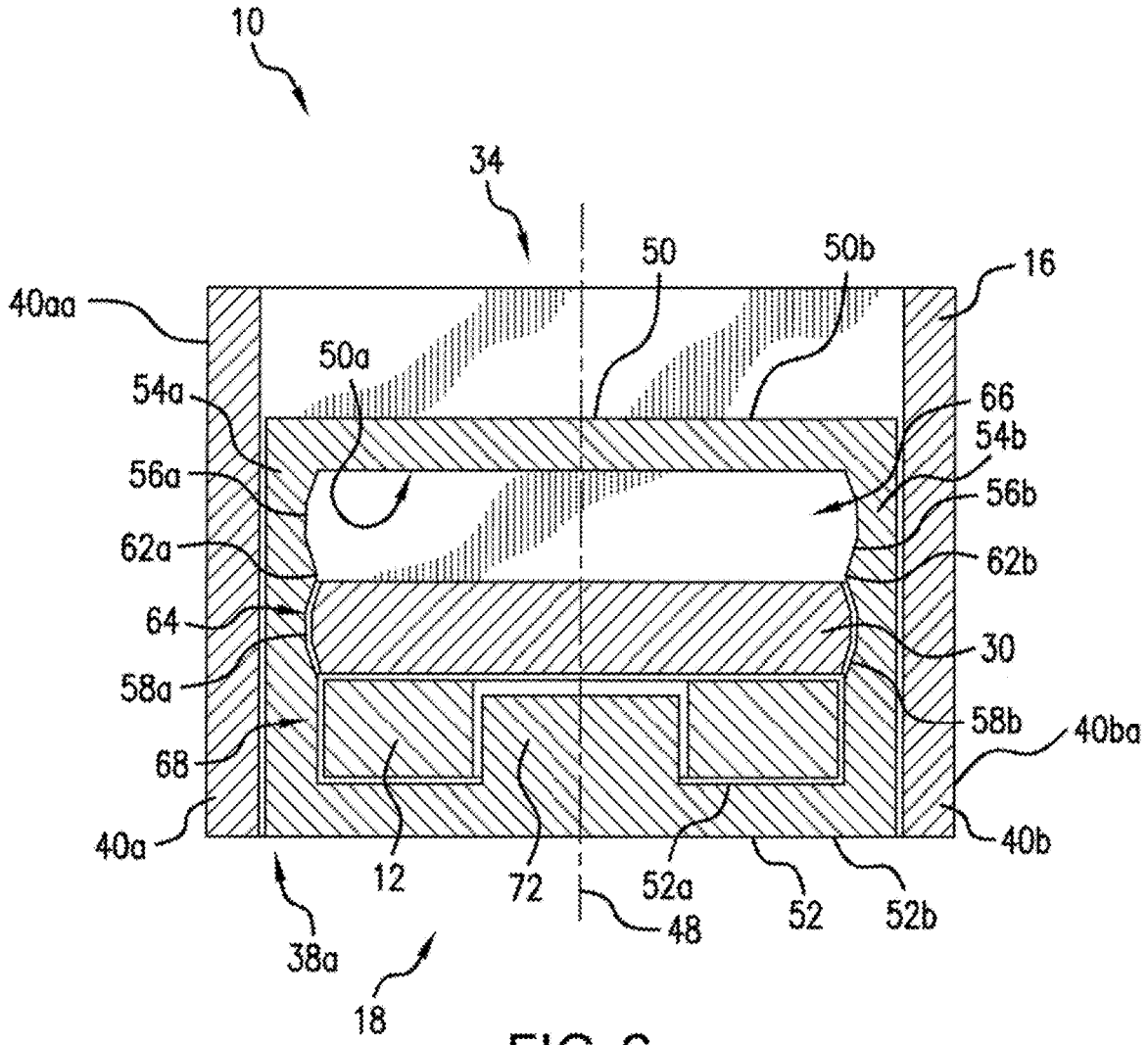
FIG. 6 is a sectional elevation view along line 4-4 of FIG. 1 of the wiring protection device in the lock position with the wiring harness.

As shown in FIGS. 4-6 and as will be described in more detail hereinafter, the first locking member 18 defines a lock position in which the lug 12 cannot be inserted into or removed from the distal region 28 of the main body 16 and an unlock position in which the lug 12 can be inserted into and also removed from the distal region 28 of the main body 16.

Notably, FIG. 4 shows the first locking member 18 in the lock position without the lug 12, whereas FIG. 6 shows the first locking member 18 in the lock position with the tab 13 of the lug 12 received in the distal region 28 of the wiring protection device 10. Further, FIG. 5 illustrates the first locking member 18 in the unlock position with the tab 13 of the lug 12 received in the distal region 28 of the wiring protection device 10.

With reference to FIGS. 4-6, the first locking member 18 can include a first top wall 50 with a first top interior surface 50*a* and a first top exterior surface 50*b*. The first top interior surface 50*a* and the first top exterior surface 50*b* can face in opposite directions to one another. The first locking member 18 can also include a first bottom wall 52 with a first bottom interior surface 52*a* and a first bottom exterior surface 52*b*. The first bottom interior surface 52*a* and the first bottom exterior surface 52*b* can face in opposite directions to one another.

The first top interior surface 50*a* can face toward the upper face 30*aa* of the ledge portion 30 and in a same direction as the lower face 30*bb* of the ledge portion 30. Further, the first top exterior surface 50*b* can face in a same direction that the upper face 30*aa* faces and an opposite direction to which the lower face 30*bb* of the ledge portion 30 faces.

The first top interior surface 50*a* can be generally parallel to the upper face 30*aa* and the lower face 30*bb* of the ledge portion 30 and be spaced from the lower face 30*bb*. Finally, the first top exterior surface 50*b* can be generally parallel to the upper face 30*aa* and the lower face 30*bb* so as to be spaced from the from the ledge portion 30.

The first bottom exterior surface 52*b* can face in a same direction as the lower surface 36*a* and opposite to the first top interior surface 50*a*. The first locking member 18 can also include a pair of first side walls 54*a*, 54*b* with a pair of respective first side interior surfaces 54*aa*, 54*ba* and first side exterior surfaces 54*ab*, 54*bb*. The respective first side interior surface 54*aa*, 54*ba* and the respective first side exterior surfaces 54*ab*, 54*bb* can face in opposite directions to one another. As illustrated, the first side walls 54*a*, 54*b* are laterally inset from the pair of main body side walls 40*a*, 40*b*. Thus, there can be a minimum amount of space between the first side exterior surfaces 54*ab*, 54*bb* of the first side walls 54*a*, 54*b* and the main body side walls 40*a*, 40*b* to ensure that the first locking member 18 can be slidably received in the main body 16 without interference.

The first top wall 50, the first bottom wall 52, and the pair of first side walls 54*a*, 54*b* cooperate to define a first lug receiving passage 68 that selectively receives the lug 12. As illustrated, the first lug receiving passage 68 is a somewhat hollow rectangular shape in cross-section. For brevity, the elements that make up the second locking member 22 will not be described, but will be understood to be the same in shape and function as the first locking member 18 unless otherwise noted.

The top wall of the first locking member 18 is in fluid communication with the first unlocking port 34*a*. Further, the top wall of the first locking member 18 can be spaced from and generally parallel with the first bottom wall 52. Additionally, the top wall of the first locking member 18 can be spaced from and generally parallel to the upper wall 32, and more particularly, the upper wall 32 surface of the main body 16.

The first bottom wall 52 of the first locking member 18 is in fluid communication with the first locking port 38*a* and the first locking port 38*a* allows selective slidable passage of the first locking member 18 along the engagement axis 46. The first bottom wall 52, and more particularly, the first bottom interior surface 52*a* can be spaced from and generally parallel to the lower surface 36*a* of the main body 16, independent of a position of the first locking member 18 with respect to the main body 16.

The first locking member 18 can also include a first engagement peg 72 that extends from the first bottom wall 52, and more particularly from the first bottom interior surface 52*a* toward the first top interior surface 50*a* of the first top wall 50. The first engagement peg 72 is spaced from the first top wall 50 to allow for receipt of the lug 12 between the first top wall 50 and the first bottom wall 52. Notably, the first engagement peg 72 can extend through the first aperture 13*a* of the lug 12. As the first engagement peg 72 can be sized and shaped to compliment the first aperture 13*a* of the tab 13 of the lug 12, a mechanically secure connection between the wiring protection device 10 and the wiring harness 14 is ensured. Such complimentary shape between the first aperture 13*a* and the first engagement peg 72 also minimizes any misalignment that could occur.

As illustrated, the first engagement peg 72, the first unlocking port 34*a*, and the first locking port 38*a* are disposed on the engagement axis 46 so as to facilitate proper engagement between the first locking member 18, the main body 16, and the lug 12. The first engagement peg 72 can extend from the first bottom interior surface 52*a* toward the first top wall 50 so as to define a peg height that is less than a depth of the first aperture 13*a* of the tab 13 of the lug 12 so as to provide easy insertion and removal of the wiring harness 14 from the wiring protection device 10. The peg height also helps to prevent over-travel (i.e., the first locking member 18 being received too far into the main body 16) of the first locking member 18 with respect to the main body 16 along the engagement axis 46.

The pair of first side walls 54*a*, 54*b* can be generally parallel with one another. Further, the pair of first side walls 54*a*, 54*b* can be generally parallel to the side surfaces 40*aa*, 40*ba* of the main body 16. The pair of first side walls 54*a*, 54*b* each include a first unlock groove 56*a*, 56*b* and a first lock groove 58*a*, 58*b*. As illustrated, the first lock grooves 58*a*, 58*b* of the pair of first side walls 54*a*, 54*b* cooperate to define a first lock slot 64 that corresponds to the lock position when the ledge portion 30 is received therewithin. In the lock position, the respective curved faces 30*a*, 30*b* of the ledge portion 30 face the respective first lock grooves 58*a*, 58*b* of the pair of first side walls 54*a*, 54*b* to ensure proper engagement between the main body 16 and the first locking member 18.

Further, the first unlock grooves 56*a*, 56*b* of the pair of first side walls 54*a*, 54*b* cooperate to define a first unlock slot 66 that corresponds to the unlock position when the ledge portion 30 is received therewithin. In the unlock position, the respective curved faces 30*a*, 30*b* of the ledge portion 30 face the respective first unlock grooves 56*a*, 56*b* of the pair of first side walls 54*a*, 54*b* to ensure proper engagement between the main body 16 and the first locking member 18.

The tab 13 of the lug 12 is selectively received in the first lock slot 64 when the ledge portion 30 of the main body 16 is received in the first unlock slot 66 so that the lug 12 can be inserted and removed from the first lock slot 64 (Le., the unlock position). In the unlock position, the first bottom wall 52 of the first locking member 18 and the lower surface 36*a* of the main body 16 are not aligned. The first lock slot 64 is disposed between the first unlock slot 66 and the first lug receiving passage 68 along the engagement axis 46.

The first unlock slot 66 receives the ledge portion 30 to define the unlock position. The first unlock groove 56*a*, 56*b* and the first lock groove 58*a*, 58*b* of each of the first side walls 54*a*, 54*b* can have a curved shape so that they each define a detent 62*a*, 62*b* that selectively biases the ledge portion 30 into either the first lock slot 64 or the first unlock slot 66. The detent 62*a* extends from the first side interior surface 54*aa* of the first side wall 54*a* toward the first side wall 54*b* and the detent 62*b* extends from the first side interior surface 54*ba* of the first side wall 54*b* toward the first side wall 54*a*.

As will be appreciated, the shape of the detents 62*a*, 62*b* is compatible with the curved faces 30*a*, 30*b* of the ledge portion 30 so that the wiring protection device can be easily manipulated between the locked position and the unlocked position while still providing sufficient attachment ability to the lug 12 of the wiring harness 14. Further, the first lock slot 64 and the first unlock slot 66 are in fluid communication with one another to allow movement of the ledge portion 30 therebetween. As such, the ledge portion 30 is movable between the first lock slot 64 and the first unlock slot 66.

Operation of the wiring protection device 10 will now be described starting from a position in which the wiring protection device 10 is locked and the lug 12 of the wiring harness 14 is not received by the wiring protection device 10 as shown in FIG. 4. In the locked position shown in FIG. 4, the ledge portion 30 is received in the first lock slot 64. The first bottom wall 52 of the first locking member 18 and the lower surface 36*a* of the main body 16 cooperate to define a singular unified coplanar surface only in the lock position. This singular unified coplanar surface provides a visual and tactile indication and confirmation to the user that the lug 12 of the wiring harness 14 is being protected by the wiring protection device 10.

A user would apply a downward force (i.e., toward the lower surface 36*a* of the main body 16) along the engagement axis 46 to the first locking member 18 through the first unlocking port 34*a*. This would cause the first locking member 18 to move downward with respect to the main body 16 and the ledge portion 30 to be received in the first unlock slot 66 and the lug 12 of the wiring harness 14 can be slidingly received into the cavity 24, and more particularly, in the first lock slot 64, as shown in FIG. 5.

Thus, a portion of the first locking member 18 would extend out through the first locking port 38*a* of the main body 16. As will be appreciated, all noted actions and movements could be duplicated with the second locking member 22. At this point, the lug 12 of the wiring harness 14 can freely be removed from the wiring protection device 10.

With the tab 13 of the lug 12 of the wiring harness 14 received in the wiring protection device 10, the user would then apply either an upward force (i.e., toward the upper wall 32 surface of the main body 16) on the first locking member 18 along the engagement axis 46 with the main body 16 remaining fixed or a downward force (i.e., toward the lower surface 36*a* of the main body 16) on the upper wall 32 surface with the first locking member 18 remaining fixed. This would cause the wiring protection device 10 to go from the unlocked position (FIG. 5) to the locked position (FIG. 6).

As such, the wiring protection device 10 would go from a position in which the first bottom wall 52 of the first locking member 18 and the lower surface 36*a* of the main body 16 did not share a common plane to a position in which the first bottom wall 52 and the lower surface 36*a* cooperate to define a singular unified coplanar surface.

Thus, the tab 13 would be received in the first lug receiving passage 68 and the first engagement peg 72 would extend through the first aperture 13*a* of the lug 12 of the wiring harness 14. Accordingly, the lug 12 would be protected from damage, but can easily accessed by the user by merely manipulating the wiring protection device 10 to the unlocked position as previously described.

A wiring protection device has been described above with particularity. Modifications and alterations will occur to those upon reading and understanding the preceding detailed description. The invention, however, is not limited to only the embodiments described above. Instead, the invention is broadly defined by the appended claims and the equivalents thereof.

The invention claimed is:

1. A wiring protection device, comprising:

a main body defining a cavity for receipt of an associated lug of an associated wiring harness; and a first locking member that is slidably received in the main body to define a lock position that engages the associated lug to prevent removal of the associated lug from the main body and an unlock position that does not engage the associated lug and allows removal and installation of the associated lug out of and into the main body, wherein the first locking member defines a lock slot that corresponds to the lock position and an unlock slot that corresponds to the unlock position, the lock slot and the unlock slot being in fluid communication with one another.

2. The wiring protection device of claim 1, wherein the main body includes a ledge portion that extends through the first locking member, the ledge portion being movable between the lock slot of the first locking member and the unlock slot of the first locking member.

3. The wiring protection device of claim 1, wherein the first locking member is slidably received in the main body so as to define an engagement axis, and wherein the engagement axis is orthogonal to a lug insertion axis that is defined by insertion of the associated lug in the cavity of the main body.

4. The wiring protection device of claim 1, wherein the main body includes a upper wall with an upper surface and a lower wall with a lower surface that are generally parallel to one another, the upper wall and the lower wall being spaced from one another by a pair of main body side walls that are spaced from one another, wherein the upper surface and the lower surface face in opposite directions, and wherein the pair of main body side walls are generally parallel to one another.

5. The wiring protection device of claim 4, the upper wall defining a first unlocking port and the lower wall defining a first locking port, wherein the first unlocking port is in fluid communication with a top wall of the first locking member and the first locking port selectively allows passage of the first locking member.

6. The wiring protection device of claim 5, wherein the first locking member is slidingly received in the main body so as to define an engagement axis and the first unlocking port and the first locking port are disposed on the engagement axis.

7. The wiring protection device of claim 4, wherein the first locking member includes a first top wall with a first top exterior surface and a first bottom wall with a first bottom exterior surface, the first top exterior surface and the first bottom exterior surface facing in opposite directions to one another, wherein the first bottom exterior surface faces in a same direction as the lower surface of the main body, the first top wall and the first bottom wall being spaced from one another by a pair of first side walls each with a first side surface, the first side walls being spaced from one another and the respective first side surfaces facing in opposite directions to one another, and wherein the pair of main body side walls are generally parallel to the pair of first side walls of the first locking member.

8. The wiring protection device of claim 7, wherein the first bottom exterior surface of the first bottom wall of the first locking member and the lower surface of the lower wall of the main body cooperate to define a singular unified coplanar surface only in the lock position.

9. The wiring protection device of claim 1, wherein the first locking member includes a first engagement peg that upwardly extends from a first bottom wall of the first locking member, the first locking member being slidably received in the main body so as to define an engagement axis and the main body includes a upper wall and a lower wall that are spaced from one another, the upper wall and the lower wall defining an first unlocking port and a first locking port, respectively, and wherein the first engagement peg, the first unlocking port and the first locking port are all disposed along the engagement axis.

10. A wiring protection device, comprising:

a main body defining a cavity for receipt of an associated lug of an associated wiring harness; and a first locking member that is slidably received in the main body to define a lock position that engages the associated lug to prevent removal of the associated lug from the main body and an unlock position that does not engage the associated lug and allows removal and installation of the associated lug out of and into the main body, wherein the first locking member includes a first top wall and a first bottom wall that are spaced from one another by a pair of first side walls that are spaced from one another.

11. The wiring protection device of claim 10, wherein the first top wall, the first bottom wall. and the pair of first side walls cooperate to define a first lug receiving passage that selectively receives the associated lug of the associated wiring harness, the first locking member defining a lock slot that corresponds to the lock position and an unlock slot that corresponds to the unlock position, and wherein the lock slot is disposed between the unlock slot and the first lug receiving passage.

12. The wiring protection device of claim 10, the first locking member further including a first engagement peg that extends from the first bottom wall toward the first top wall, the first engagement peg being spaced from the first top wall to allow for receipt of the associated lug between the first top wall and the first bottom wall.

13. The wiring protection device of claim 10, the main body including a ledge portion that extends through the first locking member, wherein each of the first side walls of the pair of first side walls defines a first unlock groove and a first lock groove, the first unlock grooves and the first lock grooves of the pair of the first side walls cooperating to define a first unlock slot and a first lock slot, respectively, wherein the first unlock slot receives the ledge portion during the unlock position and the first lock slot receives the ledge portion during the lock position, wherein the first unlock groove and the first lock groove of each of the first side walls of the pair of first side walls defines a detent that selectively biases the ledge portion into either the first unlock slot or the first lock slot, and wherein the first lock slot and the first unlock slot are in fluid communication with one another.

14. The wiring protection device of claim 13, wherein the associated lug is insertable and removable from the first lock slot when the ledge portion of the main body is received in the first unlock slot.

15. A wiring protection device, comprising:

a main body defining a cavity for receipt of an associated lug of an associated wiring harness; and a first locking member that is slidably received in the main body to define a lock position that engages the associated lug to prevent removal of the associated lug from the main body and an unlock position that does not engage the associated lug and allows removal and installation of the associated lug out of and into the main body, wherein the main body includes a proximal region and a distal region that are in fluid communication with one another, the proximal region serving as a first point of entry for the associated lug when received by the main body, wherein the proximal region defines a proximal region volume and the distal region defines a distal region volume, and wherein the proximal region volume is greater than the distal region volume.

16. The wiring protection device of claim 15, wherein the main body also includes a proximal wall with a proximal surface that is adjacent the proximal region and a distal wall with a distal surface that is adjacent the distal region, the proximal wall and the distal wall being spaced from one another and generally parallel to one another with the proximal surface and the distal surface facing in opposite directions to one another.

17. The wiring protection device of claim 16, further comprising a second locking member that is slidably received in the main body so as to selectively engage the associated lug, wherein the proximal wall defines a proximal port and the distal wall defines a distal port, the proximal port and the distal port being in fluid communication with one another, wherein the first locking member is slidably received in the distal region, and wherein the first locking member is disposed between the distal port and the second locking member and the second locking member is disposed between the first locking member and the proximal port.

18. The wiring protection device of claim 15, further comprising a second locking member that is slidably received in the main body to selectively engage the associated, lug, wherein the first locking member and the second locking member independently engage the associated lug.

19. The wiring protection device of claim 15, wherein the main body and the first locking member are constructed of a same material and the same material is an electrical insulator.

20. The wiring protection device of claim 15, wherein the first locking member is slidably received in the main body so as to define an engagement axis, and wherein the engagement axis is orthogonal to a lug insertion axis that is defined by insertion of the associated lug in the cavity of the main body.

* * * * *